US007531733B2

(12) United States Patent
Steele

(10) Patent No.: US 7,531,733 B2
(45) Date of Patent: May 12, 2009

(54) ELECTRONIC DRUM PEDAL

(76) Inventor: Mark David Steele, 1931 Waterford Estates Dr., New Smyrna Beach, FL (US) 32168

( * ) Notice: Subject to any disclaimer, the term of this patent is extended or adjusted under 35 U.S.C. 154(b) by 166 days.

(21) Appl. No.: 11/440,022

(22) Filed: May 25, 2006

(65) Prior Publication Data

US 2006/0207408 A1 Sep. 21, 2006

Related U.S. Application Data

(63) Continuation-in-part of application No. 10/873,344, filed on Jun. 21, 2004, now Pat. No. 7,074,997.

(51) Int. Cl.
*G10D 13/02* (2006.01)

(52) U.S. Cl. ..... 84/422.1; 84/225

(58) Field of Classification Search ..... 84/422.1, 84/422, 426, 104, 411, 72, 225, 229, 353, 84/366

See application file for complete search history.

(56) References Cited

U.S. PATENT DOCUMENTS

| | | | | | |
|---|---|---|---|---|---|
| 2,484,302 | A | * | 10/1949 | Laverents | 84/422.1 |
| 3,598,011 | A | * | 8/1971 | Henkle | 84/280 |
| 3,988,957 | A | | 11/1976 | Escamilla | |
| 3,994,197 | A | | 11/1976 | Bills | |
| 4,188,853 | A | * | 2/1980 | Bills | 84/422.1 |
| 4,262,576 | A | * | 4/1981 | Gorsky et al. | 84/422.1 |
| 4,491,050 | A | | 1/1985 | Franzmann | |
| 4,744,279 | A | | 5/1988 | Livingston | |
| 4,782,733 | A | | 11/1988 | Herring | |
| 4,817,485 | A | | 4/1989 | Bozzio et al. | |
| 4,841,830 | A | | 6/1989 | Yamashita | |
| 5,090,289 | A | | 2/1992 | Holcomb | |
| 5,396,826 | A | | 3/1995 | Lombardi | |
| 5,591,929 | A | | 1/1997 | Wellman | |
| 5,866,830 | A | | 2/1999 | Onyszkanycz | |
| 6,002,076 | A | | 12/1999 | Karn | |
| 6,255,574 | B1 | | 7/2001 | Sapienza | |
| 6,278,046 | B1 | | 8/2001 | Sikra et al. | |
| 6,369,308 | B1 | | 4/2002 | Orr | |
| 6,541,686 | B2 | | 4/2003 | O'Donnell | |
| 6,649,819 | B1 | * | 11/2003 | Boegli | 84/421 |
| 6,664,457 | B1 | | 12/2003 | King | |
| 6,683,240 | B1 | | 1/2004 | Cubranich | |
| 2003/0144115 | A1 | * | 7/2003 | Duvernay et al. | 482/79 |
| 2004/0025667 | A1 | * | 2/2004 | Hampton, Jr. | 84/426 |
| 2005/0056997 | A1 | * | 3/2005 | Wakitani et al. | 273/148 B |

* cited by examiner

*Primary Examiner*—Jeffrey Donels
*Assistant Examiner*—Jianchun Qin
(74) *Attorney, Agent, or Firm*—William C. Schrot; Edell, Shapiro & Finnan LLC

(57) ABSTRACT

A foot pedal for electronic drums includes a lower tab or pedal or other extension for triggering by pressing down, and an upper tab or pedal or other extension for triggering by raising the foot. Also included is the joining of the upper and lower extensions (tab, pedal or other) into a pedal assembly that includes: a hinge or axle or other device which allows the pedal assembly to rotate in an arc; a striking device (stick, rod or other) that is attached to the pedal assembly and hits impact sensitive electronic drum triggering devices (pads, tubes or others); and an elastic device or spring which returns the pedal assembly to the neutral (at-rest) position.

24 Claims, 15 Drawing Sheets

ELECTRONIC DRUM PEDAL

CROSS REFERENCE TO RELATED APPLICATION AND CLAIM TO PRIORITY

This application is a continuation-in-part of application Ser. No. 10/873,344, filed Jun. 21, 2004 now U.S. Pat. No, 7,074,997, for Mark D. Steele, the disclosure of which is incorporated herein by reference and to which priority is claimed under 35 U.S.C. §120.

FIELD OF THE INVENTION

The present invention is directed to an apparatus for triggering electronic drums. The apparatus includes a base, a hub body pivotably connected to the base, an upper tab extending outwardly from the hub body, and a pedal spaced from the upper tab to form a space therebetween for receiving a user's toes. A linkage has a first portion pivotally connected to the hub body and a second portion pivotally connected to the pedal, thereby pivotally connecting the pedal to the hub body. First and second impact sensitive electronic triggering devices are provided. An elongate striking device has a first end connected to the hub body and a second end extending outwardly from the hub body and disposed between the first and second triggering devices. The striking device contacts the first triggering device when the pedal is actuated, and contacts the second triggering device when the upper tab is actuated.

SUMMARY OF THE INVENTION

The present invention is directed to a drum pedal whereby raising and lowering the foot can trigger two beats instead of one, thus creating sounds at twice the rate of conventional pedals.

The disclosed invention reduces the force required to produce triggering, allowing increased speed and control. In addition, the disclosed invention reduces the momentum inherent in the device, which allows a very rapid return to the start position, increasing speed and control. The disclosed drum pedal may include an adjustable return spring tension, and only one moving part. The disclosed pedal facilitates very rapid, controlled drum beats with a single foot, retaining the use of the hi-hat instrument.

According to a disclosed embodiment, an electronic drum pedal operably associated with sensor pads is provided. Multiple sensors are provided in each pad, so that the drum pedal can combine any of the many sounds available in electronic drums, for example; a low conga and cowbell on the downstroke, with a high conga and tambourine on the upstroke.

In accordance with another embodiment of the invention, there is disclosed a foot pedal apparatus for triggering electronic drums comprising impact sensitive electronic drum triggering devices (pads, tubes or other), a lower tab or pedal or other extension for triggering by pressing down, an upper tab or pedal or other extension for triggering by raising the foot, a method of combining the upper and lower extensions (tab, pedal or other) into a pedal assembly, a hinge or axle or other device which allows the pedal assembly to rotate in an arc, support arms or brackets to hold the axle or shaft, a striking device (stick, rod or other) which is attached to the pedal assembly and hits the impact-sensitive electronic drum triggering devices, a footpad to absorb most of the weight of the foot and leg, and an elastic device or spring which returns the pedal assembly to the neutral position.

The present invention is also directed to an apparatus for triggering electronic drums. The apparatus includes a base, a hub body pivotably connected to the base, an upper tab extending outwardly from the hub body, and a pedal spaced from the upper tab to form a space therebetween for receiving a user's toes. A linkage has a first portion pivotally connected to the hub body and a second portion pivotally connected to the pedal, thereby pivotally connecting the pedal to the hub body. First and second impact sensitive electronic triggering devices are provided. An elongate striking device has a first end connected to the hub body and a second end extending outwardly from the hub body and disposed between the first and second triggering devices. The striking device contacts the first triggering device when the pedal is actuated, and contacts the second triggering device when the upper tab is actuated.

Also disclosed is an apparatus for triggering electronic drums comprising a base, a hub body pivotably connected to the base, a pedal, and a foot retaining device attached to the pedal for securing a user's foot to the pedal. A linkage has a first portion pivotally connected to the hub body and a second portion pivotally connected to the pedal, thereby pivotally connecting the pedal to the hub body. First and second impact sensitive electronic triggering devices are provided. An elongate striking device has a first end connected to the hub body and a second end extending outwardly from the hub body and disposed between the first and second triggering devices. The striking device contacts the first triggering device when the pedal is depressed, and contacts the second triggering device when the pedal is lifted.

Other advantages of the present invention will become apparent from the following descriptions, taken in connection with the accompanying drawings, wherein, by way of illustration and example, an embodiment of the present invention is disclosed.

BACKGROUND OF THE INVENTION

This invention relates generally to the field of musical instruments and more specifically to a foot pedal for electronic drums.

Conventional drum pedals are widely used, and require significant mechanical leverage to impact a fairly heavy drum beater with the drum head. If the throw of the beater is shortened or the mass is reduced, there is often not enough sound produced. Electronic drums, on the other hand, detect an impact and amplify the sound after computing the proper note or sound as selected by the musician. Heavy beaters with lots of mass and force are no longer required, yet virtually all commercial electronic drum pedals incorporate the old pedal design because, it is thought, that's what drummers are used to. The problem is that the mass and long throw weight inherent in conventional pedals make them unnecessarily slow and hard to control.

FIGS. 9 and 9*a* show conventional drum pedal technology. Drum pedal 101 is hinged at rear 102 and is connected at the front to chain or flexible strap 103. Strap 103 is attached to lever 104 that is suspended on axle 105 using supports 112. Attached to lever 104 is a rod 106 that supports beater head 107. Arm 108 is attached to axle 105 and connected to return spring 109. Spring tension is adjustable using nut 110 that screws onto lower spring attachment bolt 111. Clamp 113 is used to attach the pedal to the shell of bass drum 114. When pedal 101 is pressed down as in FIG. 9*a*, strap or chain 103 is pulled and it in turn rotates lever 104, rod 106 and beater 107 which impacts the surface of a drum pad 115.

The arc of travel for the typical beater 116 is approximately 9 inches in length. Rod 106 and beater 107 typically weigh from one to three pounds. Pedal 101 plus chain 103 can weigh a total of several pounds. In order to move all of this mass back to the starting point, spring 109 typically has a relatively high tension. To counter the force of the spring and to move the pedal rapidly, a relatively large amount of force must be used. A moderate downstroke may require approximately 10 pounds of force, while loud playing may require significantly more. The inherent inertia of existing drum pedals makes rapid successive drum beats impossible, and the long arc of travel of the beater makes timing difficult. Many drummers compensate by adding a second bass drum, or using a remote double bass pedal played with a second foot. In both cases, the hi-hat instrument must be abandoned.

BRIEF DESCRIPTIONS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention. In addition, features of one embodiment may be incorporated into another embodiment.

Figure 2A:
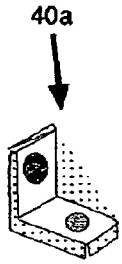
FIG. 2 is a top view of an embodiment of the present invention including stands for pad support.
Figure 2:
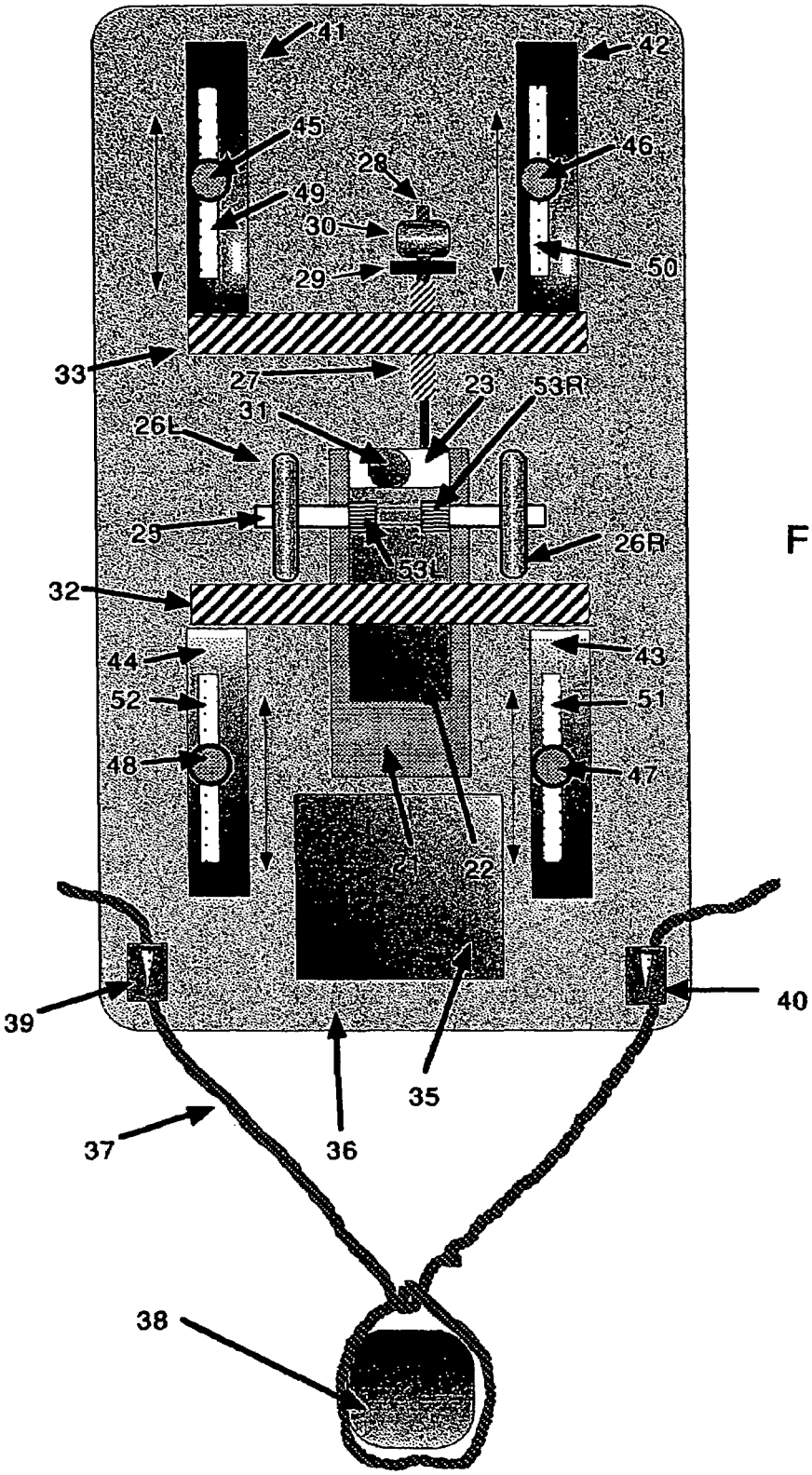
Figure 3:
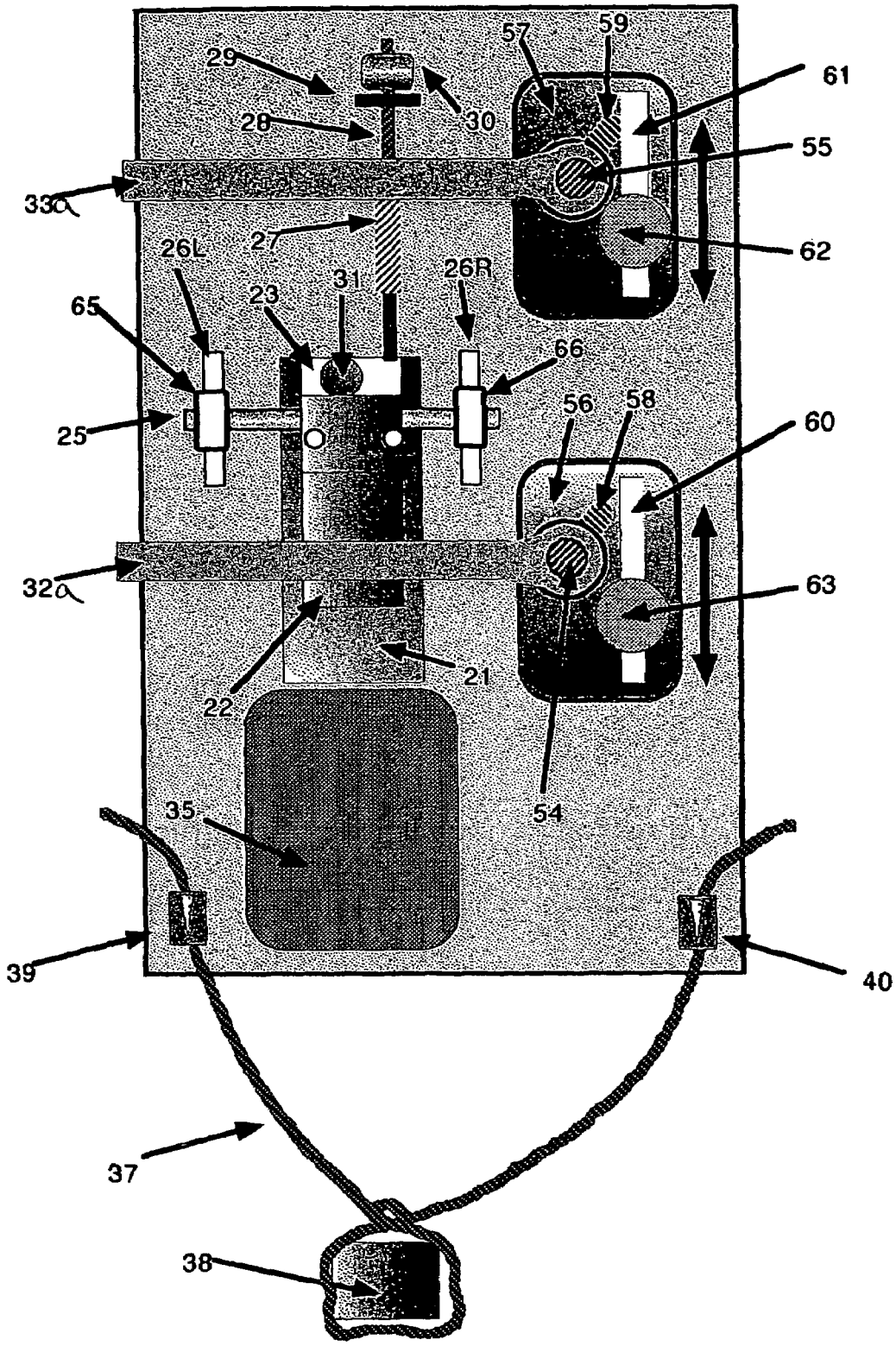
Figure 4:
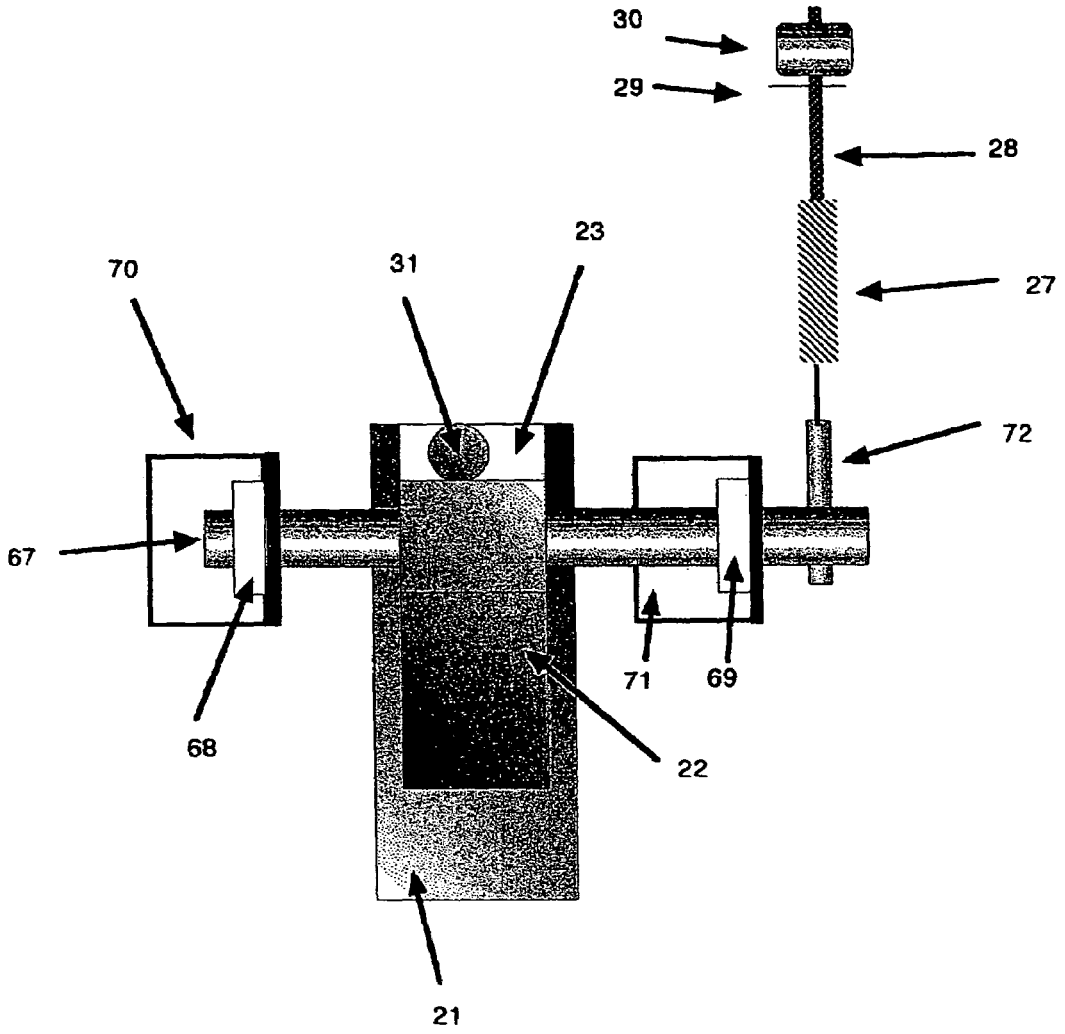
Figure 5:
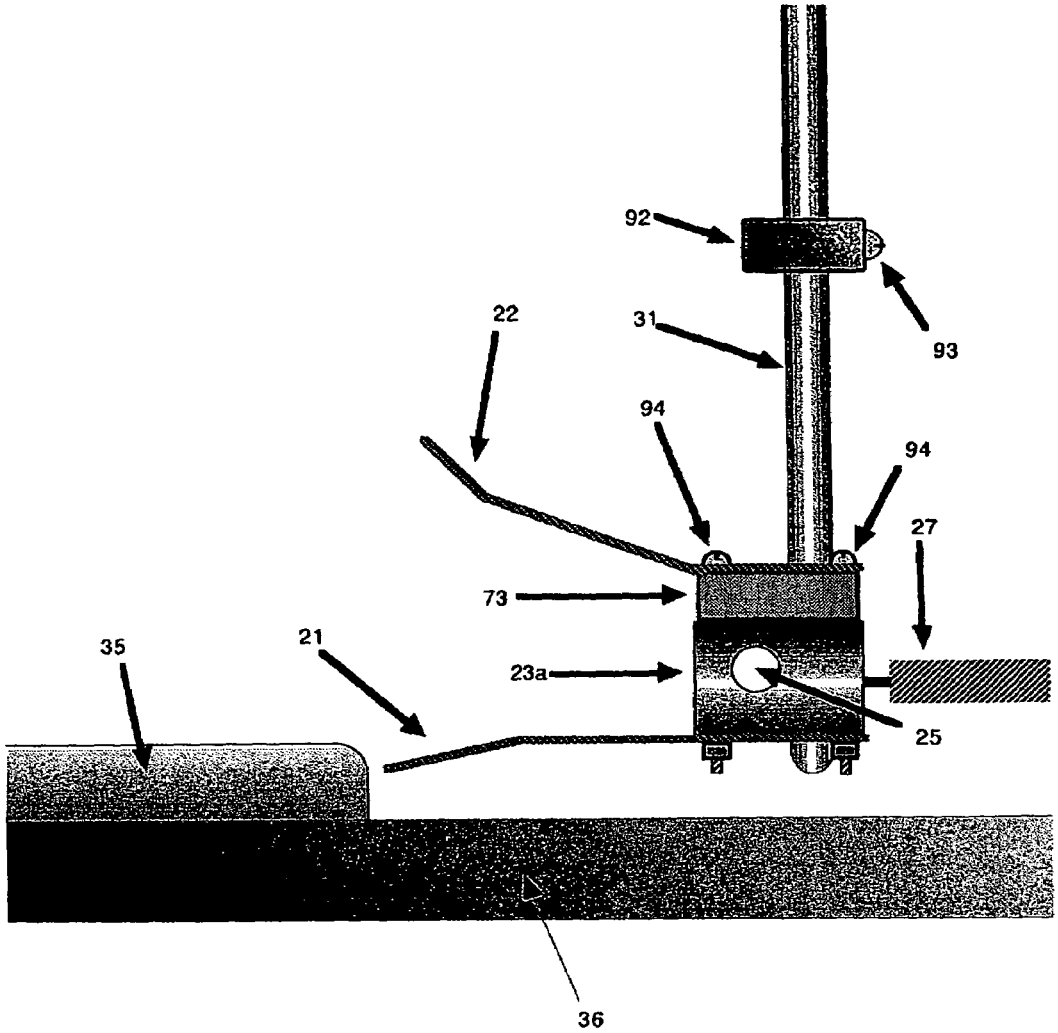
Figure 5A:
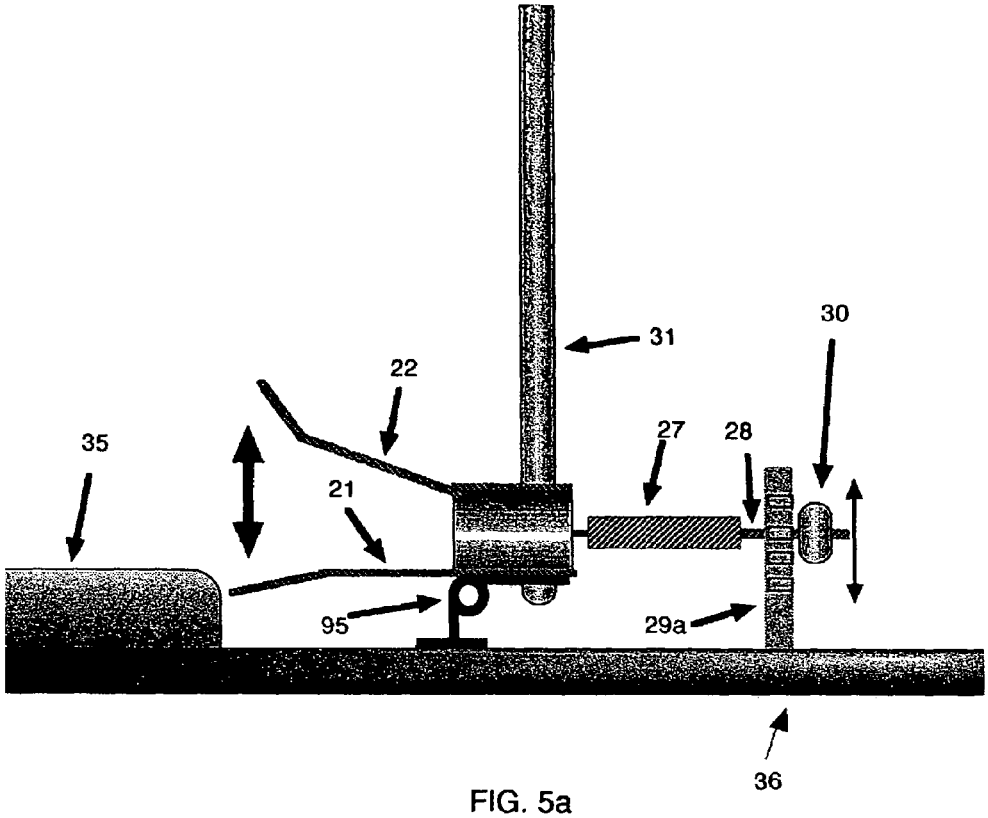
Figure 6:
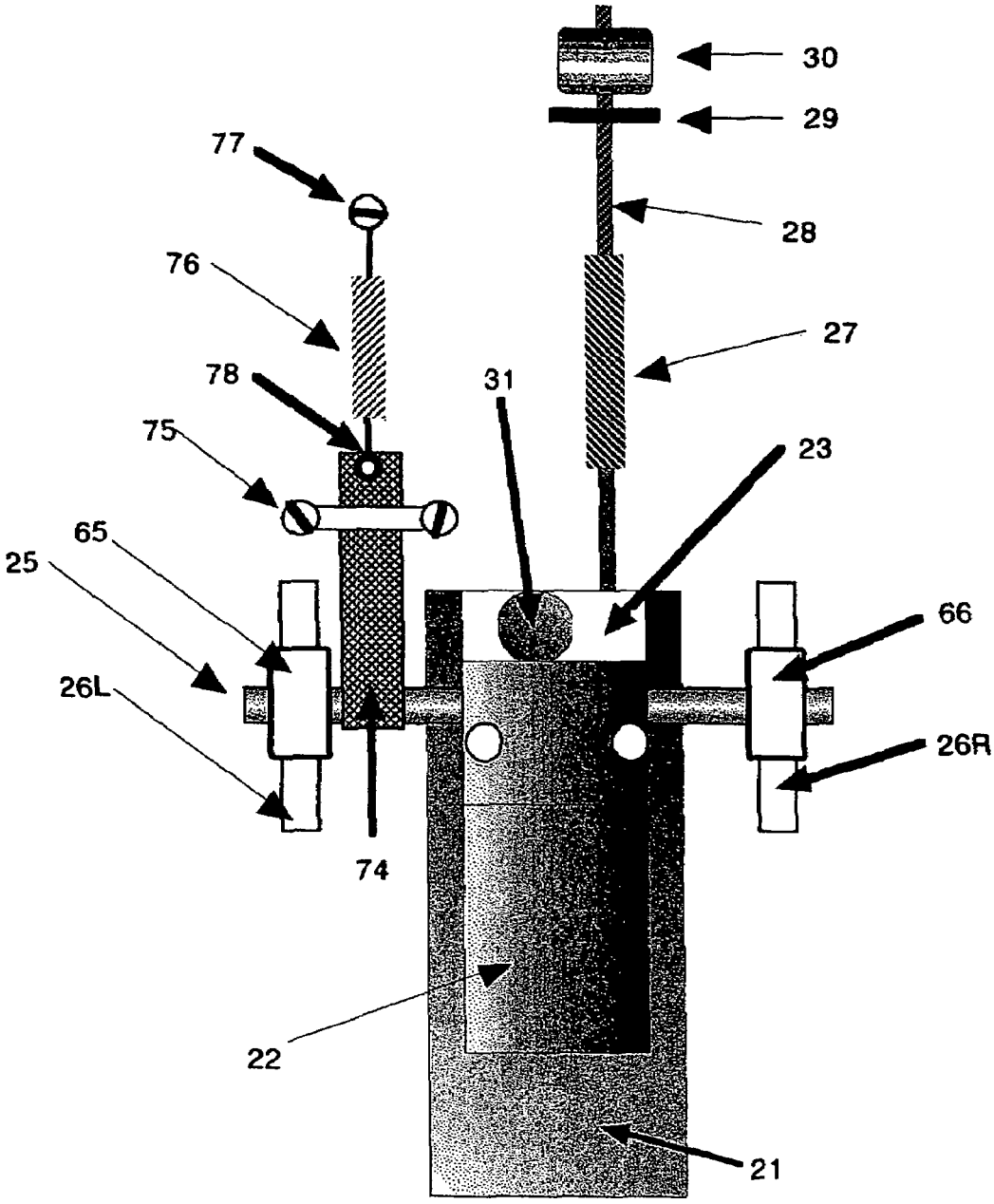
Figure 6A:
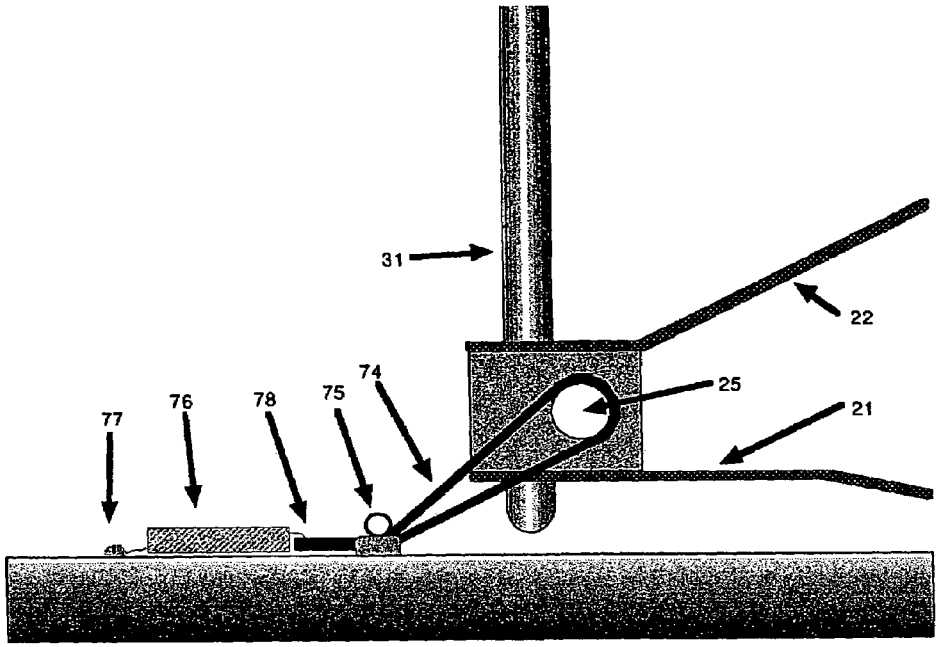
Figure 7:
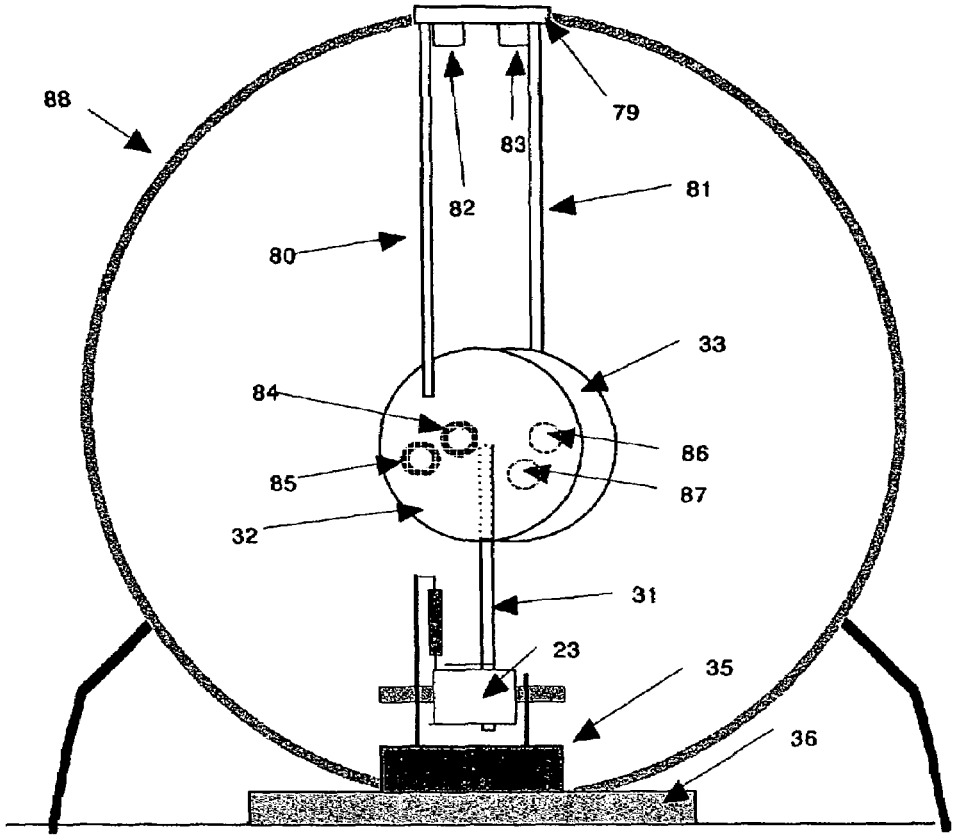
Figure 7A:
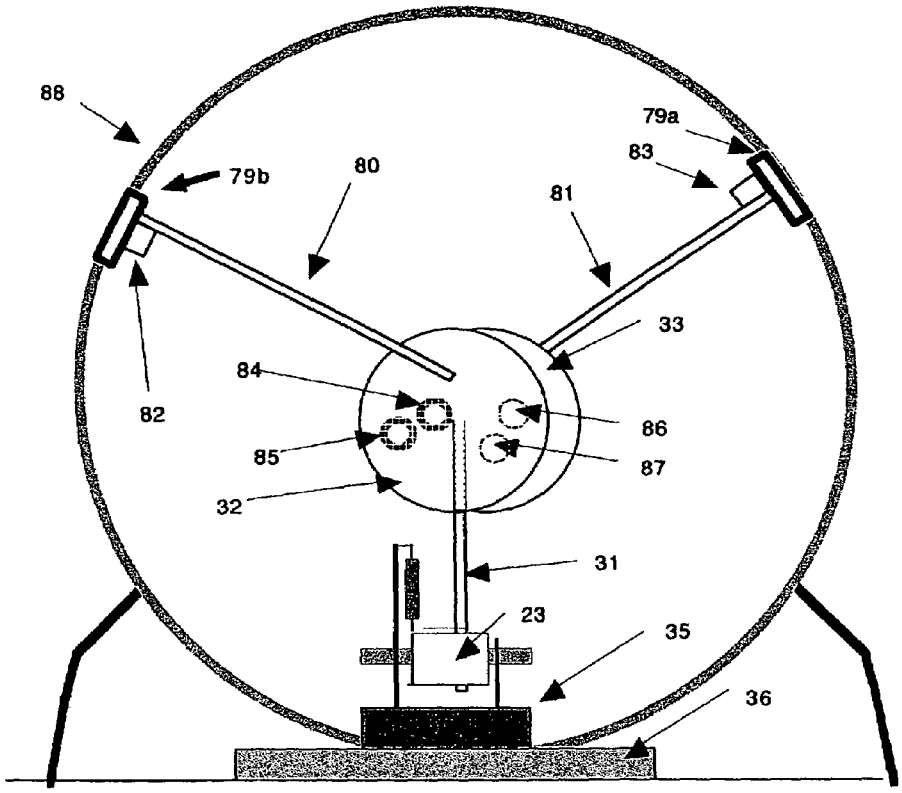
Figure 8:
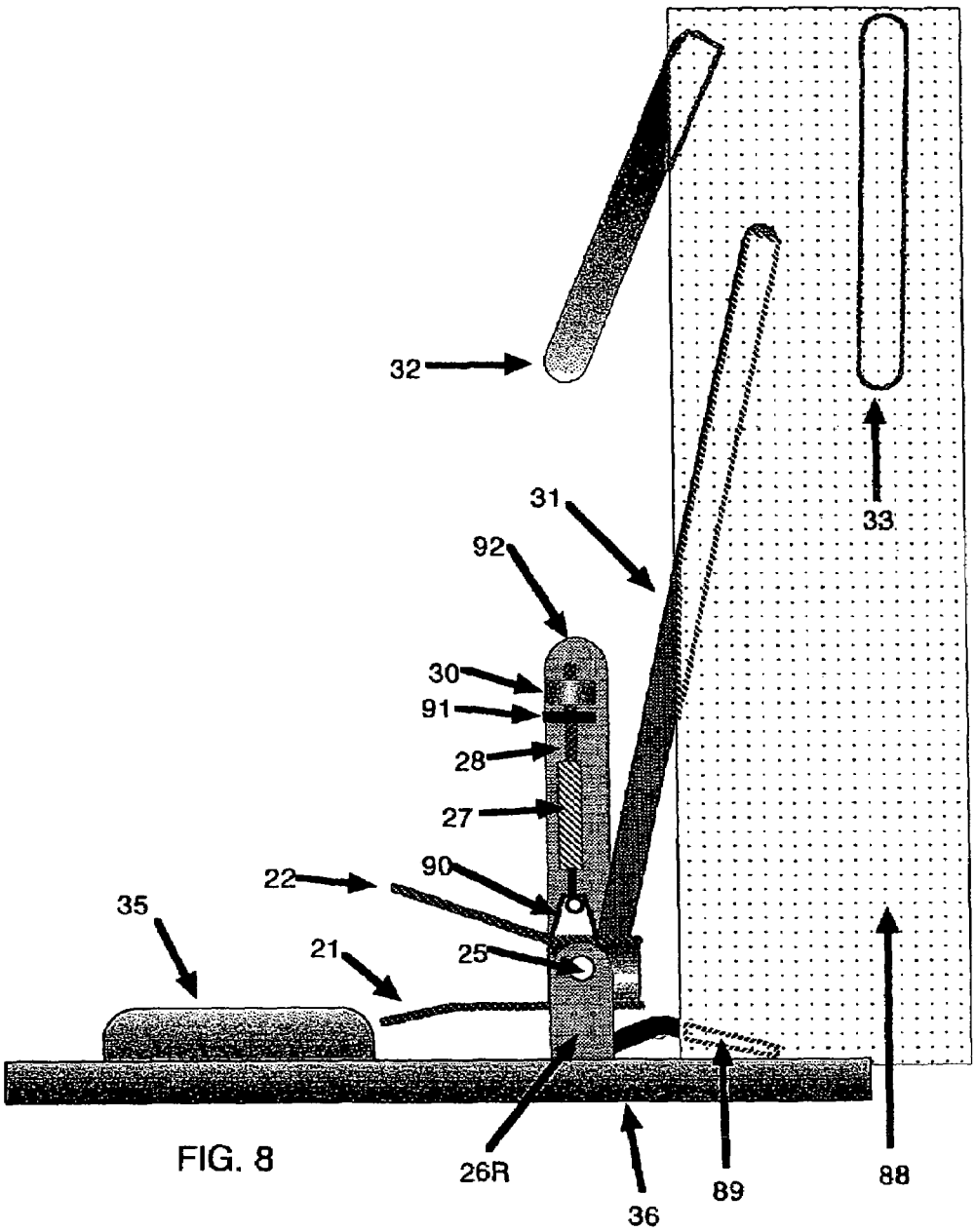
Figure 9:
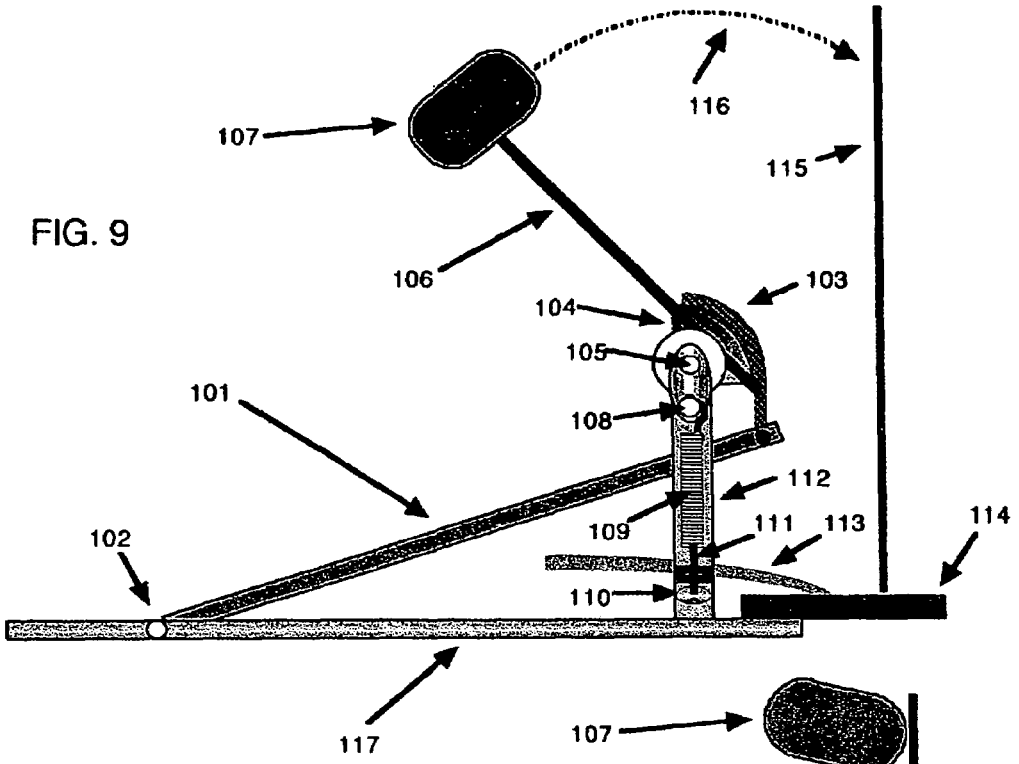
Figure 9A:
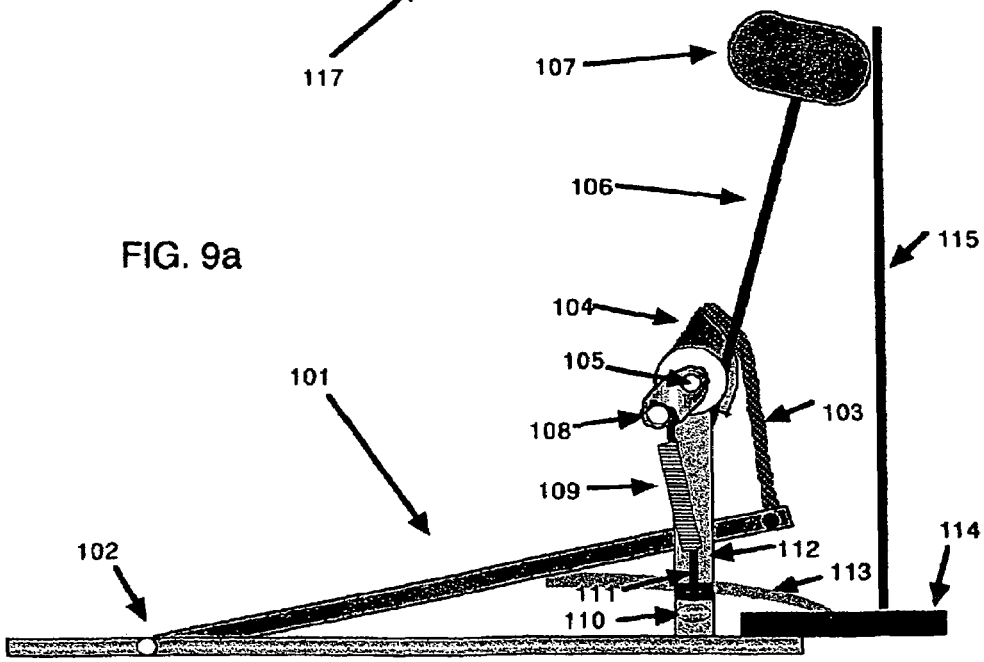
Figure 10:
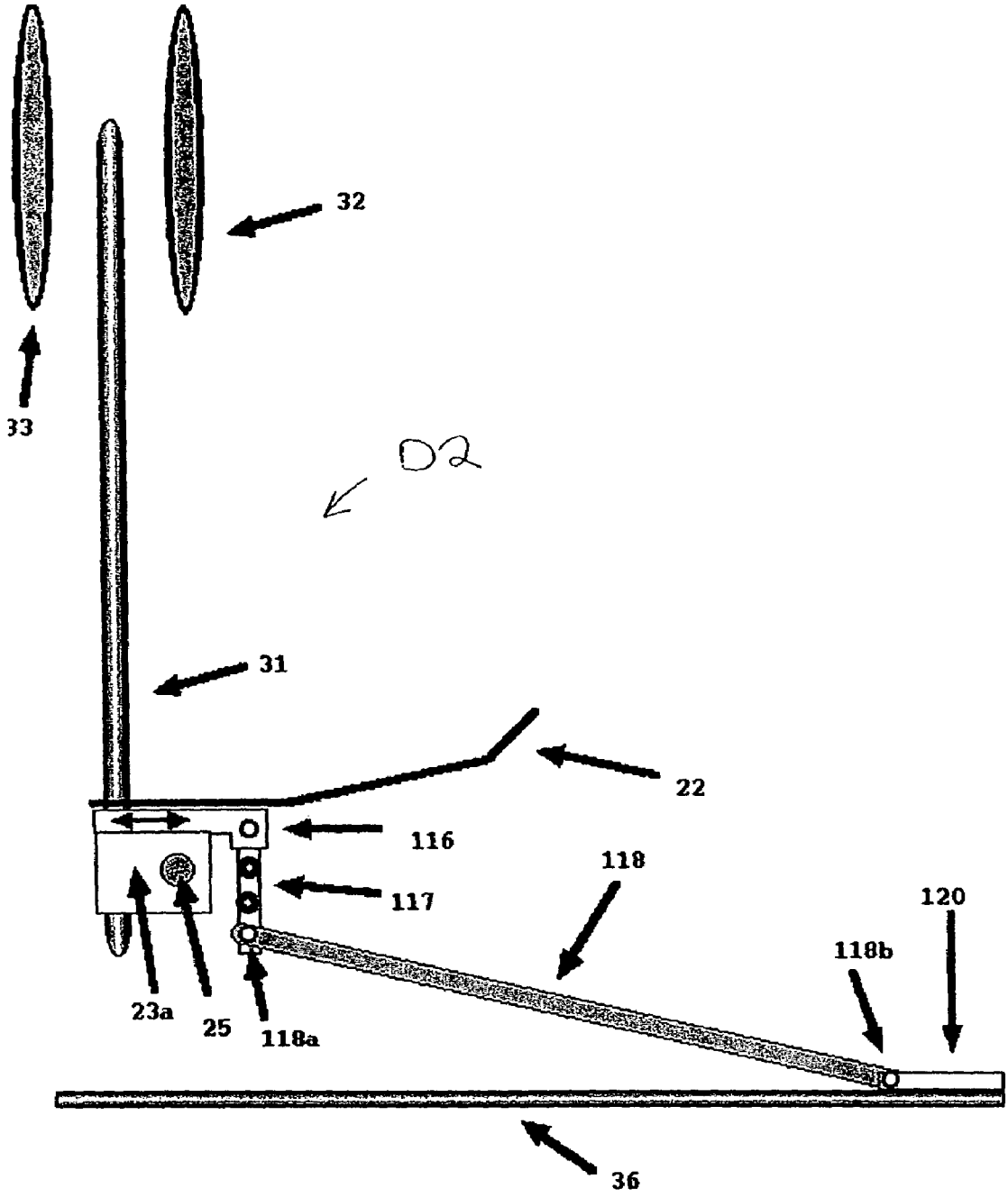
Figure 11:
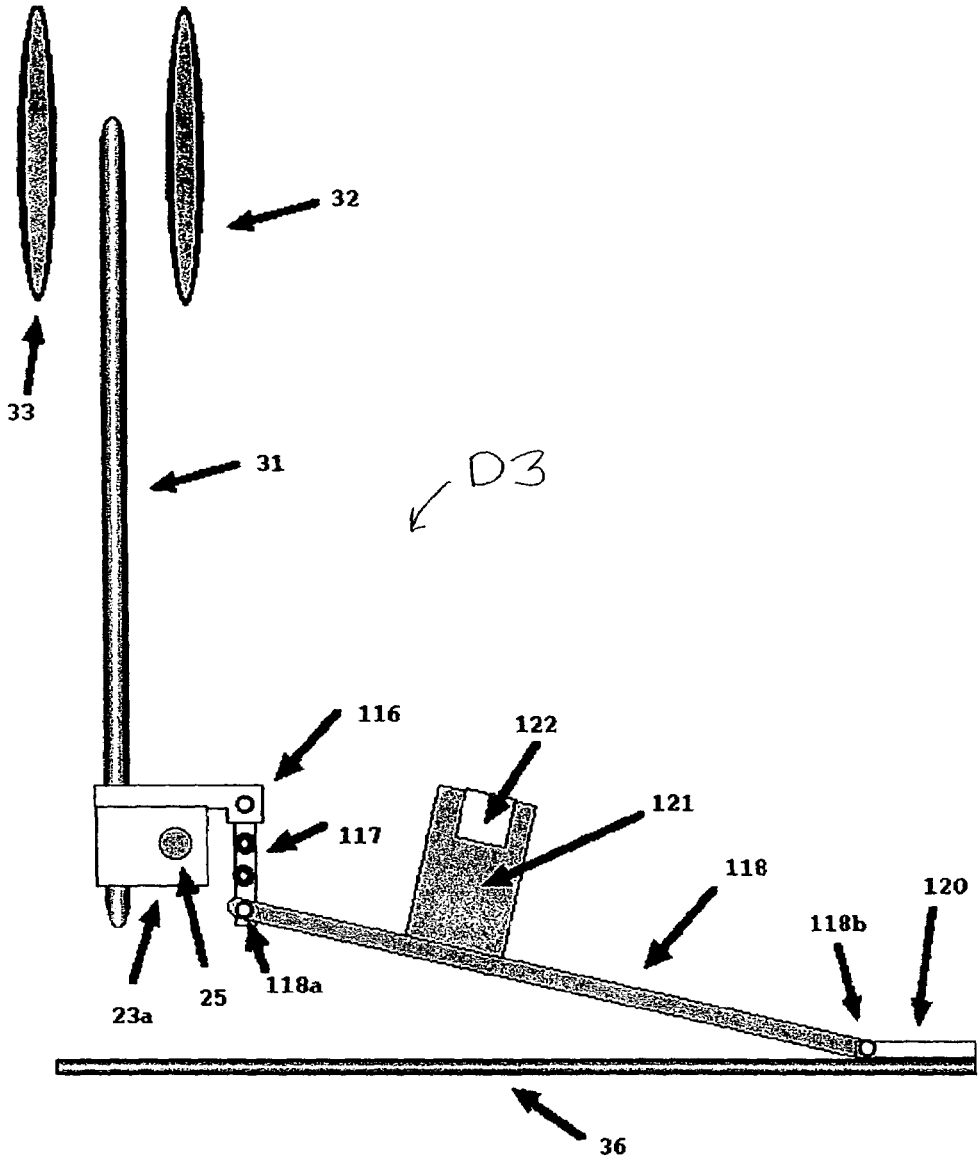
Figure 12:
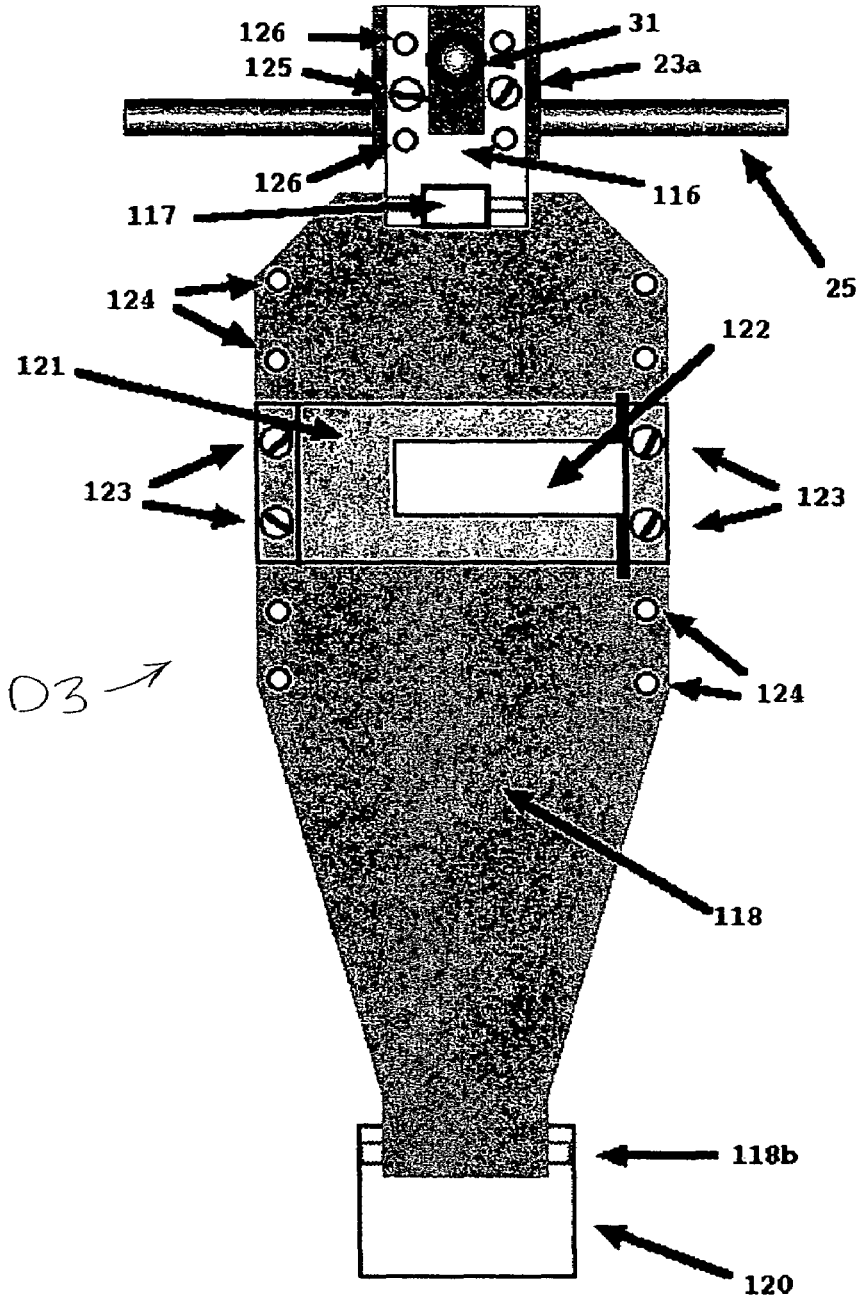

FIG. 2*a* is a perspective view of a bracket suitable for securing the rope to the base shown in FIG. 2;

FIG. 3 is a top view of an embodiment of the present invention including adjustable posts for existing drum tube triggers;

FIG. 4 is a fragmentary top view of an embodiment of the present invention including a return spring mounted to an axle;

FIG. 5 is a side view of an embodiment of the present invention including a spacer to widen the gap between tabs;

FIG. 5*a* is a side view showing a hinge in use and an adjustable return spring bracket;

FIG. 6 is fragmentary top view showing an embodiment of the present invention including a drag device;

FIG. 6*a* is a left side view showing the drag device of FIG. 6;

FIG. 7 is a rear view showing an embodiment of the present invention showing elements independently attached to a bass drum shell;

FIG. 7*a* is a rear view showing an embodiment of the present invention showing independently attached pad brackets and arms;

FIG. 8 is a side view showing an embodiment of the present invention showing a pedal configuration for use with a bass drum shell;

FIG. 9 is a side view of a conventional drum pedal at rest;

FIG. 9*a* is a side view of a conventional drum pedal striking a surface;

FIG. 10 is a side view of another embodiment of the present invention having a lower pedal and an upper tab;

FIG. 11 is a side view of another embodiment having a lower pedal with a foot retaining device; and FIG. 12 is a top view of the embodiment of FIG. 11.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
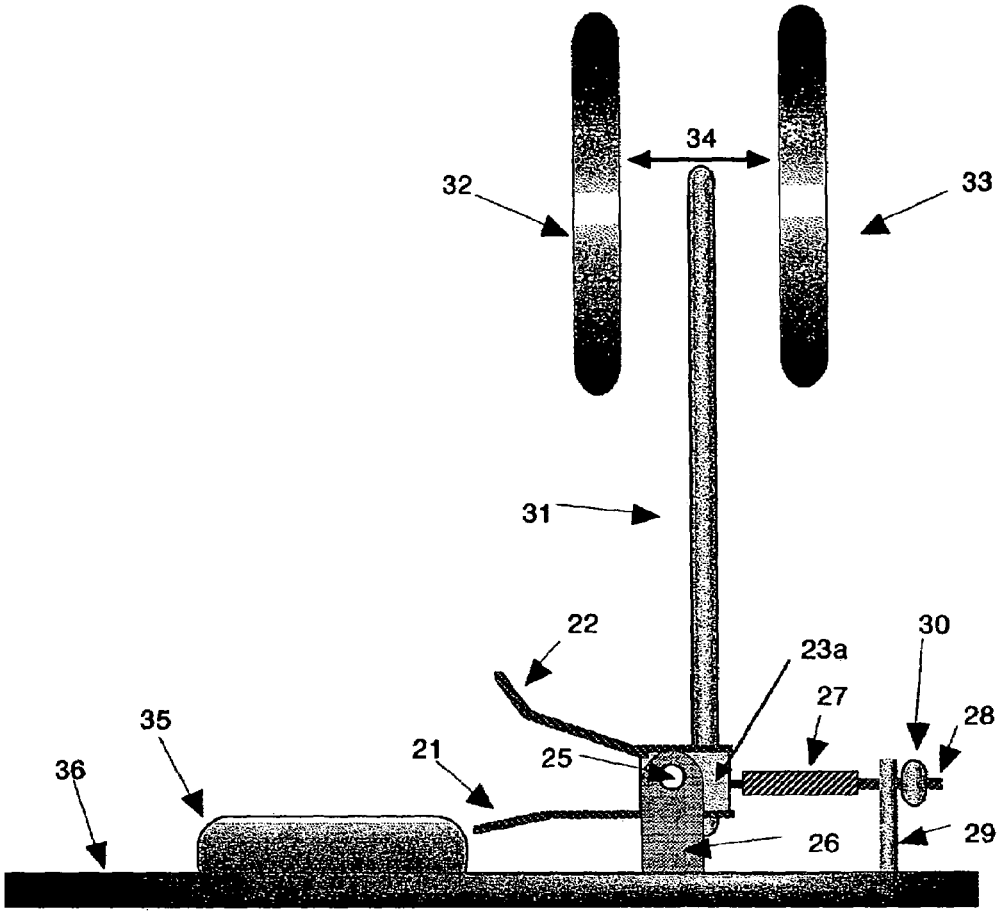
FIG. 1 is a side view of an embodiment of the present invention, with impact pad supports removed for clarity.

FIG. 1 shows a drum pedal assembly for electronic drums in accordance with one embodiment of the invention, wherein the parts identical to those shown in FIGS. 2 through 8 are designated by the same reference numerals. The disclosed drum pedal includes a lower pedal tab 21, or other type of extension, and an upper pedal tab 22, or other type of extension. Lower tab 21 and upper tab 22 are connected to a hub body 23*a* to form the main pedal assembly. This assembly rotates about an axle 25 which is suspended by axle stands 26 that are mounted to a pedal base 36. A return spring 27 is attached to the pedal assembly on one end and an adjustment screw 28 on the other. Adjustment screw 28 passes through a bracket 29 and tension may be varied using adjustment nut 30. A striking device 31, such as a stick, rod, tube or other extension, is attached on one end to the pedal assembly and the opposite end rests between two impact sensitive electronic drum triggering devices (pads, tubes or others) 32, 33. As lower pedal tab 21 is pressed down, striking device 31 hits downstroke triggering device 32. As the foot is lifted, upper pedal tab 22 is moved upward, and striking device 31 hits and triggers upstroke triggering device 33.

The arc of travel 34 between striking device 31 and either pad 32, 33 is approximately 1.5 inches. If a light wooden rod or aluminum tube 31 is used, the force required for playing the pedal apparatus is measured in ounces, rather than pounds. This allows for a relatively light return spring 27 tension, while the pedal still returns to the neutral position almost immediately. Also, upper upstroke pedal 22 allows for twice the number of beats per foot movement to be produced, effectively doubling the speed of an already very fast pedal.

Because the disclosed pedal is relatively light, fast and sensitive compared to conventional drum pedals, the weight of a drummer's foot preferably does not rest on the lower tab 21, or a sound will be produced. Therefore, a fixed footpad 35 may be provided. Footpad 35 is used to absorb most of the weight and downward force of the foot and leg.

The disclosed drum pedal is played by pushing the ball of the foot upon footpad 35, and tapping lower pedal tab 21 at the same time with the bottom of the toes so that striking device 31 actuates pad 32. A very light lifting of the toes will raise upper pedal tab 22 and subsequently trigger upstroke pad 33. Both pedal tabs 21, 22 preferably include distal ends having outwardly bent portions, which conform to the foot and optimize the mechanical response of the apparatus to foot movement.

FIG. 2 is a top view of another drum pedal assembly, which includes many of the same features described above. Identical features are referenced accordingly. In order to prevent the pedal base 36 from sliding during play, a rope 37 is attached to one leg of a drummer's stool or seat 38. The ends of rope 37 may be cleated to the device using jam cleats 39, 40. The rope ends can also be tied to the pedal base 36 using brackets 40*a*, shown in FIG. 2*a*, or some other similar device. The actual rope attachment method will vary depending upon the style of seat or throne used. This feature allows the drummer to vary his distance from and the angle relative to the apparatus. A non-skid surface may also be provided on the bottom of base 36.

As a means to adjust the position of the triggering pads, which effectively modifies the stroke length (arc of travel from at-rest to impact) of striking device 31, triggering pads 32, 33 may be suspended by angle brackets 41, 42, 43, 44. Each pad can be moved relative to striking device 31 by loosening adjustment knobs 45, 46, 47, 48, and then sliding brackets 41-44 along operably associated cutout tracks 49, 50, 51, 52. Knobs 45-48 are then re-tightened, thereby securing brackets 41-44 and thus triggering pads 32, 33 in place. Axle 25 is preferably supported by stands or brackets 26L, 26R, so that pedal assembly 23 rotates about axle 25. Optionally, bearings 53L, 53R may be provided on either side of pedal assembly 23 and surrounding axle 25.

A drum pedal assembly according to another embodiment is best shown in FIG. 3, which utilizes existing commercial drum trigger tubes ("Nimrods" or similar). In this case, trigger tubes 32*a*, 33*a* are mounted on vertical rods 54, 55 which are attached to adjustment plates 56, 57. The height of the triggering devices as well as the angle can be altered by using set screws 58, 59. The striking device 31 does not have to hit trigger tubes 32*a*, 33*a* at exactly 90 degrees. The attachment plates 56, 57 are further adjustable using cutout tracks 60, 61 and adjustment knobs 62, 63. There are dozens of triggering devices (pads, tubes, and others) on the market, and the disclosed invention may be used with most conventional triggering devices using various conventional mounting techniques.

The disclosed drum pedal may also include a rope restraining system similar to that described above, but having a different bearing system. Specifically, pedal assembly 23 is fixed to axle 25 which is suspended in bearings 65, 66 that are in turn mounted in suspension brackets or arms 26L, 26R. A variety of bearings, fittings, and configurations thereof can be used to allow the rotation of the pedal assembly. The device can also be constructed with no bearings at all.

A drum pedal assembly according to another embodiment is shown in FIG. 4, which includes pedal assembly 23 fixed to axle 67 that is suspended in bearings 68, 69 mounted in brackets or arms 70, 71. Extending from the axle is arm 72 that is connected to return spring 27 utilizing adjustment bracket, screw and nut 29, 28, 30 respectively.

FIG. 5 shows the main pedal assembly (with supports left out for clarity), and it illustrates optional spacer 73 that is used for drummers who wear shoes while playing or have thick feet. The thickness and number of spacers is in accordance with the drummer's preference. One method for combining the pedal tabs to form a main pedal assembly is shown in the use of pedal block 23*a* and four screws with nuts 94. There are several other possible ways to form the main pedal assembly. I have also included an optional weighted collar 92 that is held in position with set screw 93. Changing the position of this collar allows the drummer to vary the momentum (feel) of the device according to personal preference.

Shown in FIG. 5*a* is a bracket 29*a* for spring adjustment screw 28 and nut 30. Several holes in bracket 29*a* have been drilled at differing distances from the base 36. The angle of the at-rest position of the pedal assembly will change as the height of adjustment screw 28, and corresponding angle of return spring 27, is changed. Another difference depicted in this example is hinge 95 that is used in place of an axle to allow the main pedal assembly to rotate in an arc.

If the triggering devices (pads, tubes or others) are set in close proximity to the striking device, the return spring can sometimes cause the striking device to overshoot the at-rest position and hit the opposite pad unintentionally. To prevent this unwanted characteristic, a dampening device may be provided.

FIGS. 6 and 6*a* show a pedal assembly with an optional dampening device installed, in order to limit the free-play and spring induced oscillations of pedal assembly 23. Main pedal assembly 23 is fixed to axle 25 with bearings and brackets in the same configuration as FIG. 3. Strap 74 is wrapped around axle 25 then both ends are routed under raised bar 75 which is attached to the base of the apparatus. Bar 75 is elevated just enough for the strap ends to pass under and move freely. Spring 76 or other elastic device has one end attached to strap ends 78 and the other end of spring 76 is attached to the base with set screw 77. The tighter spring 76 tension becomes, the more free-play is reduced. This allows the triggering pads (not shown) to be placed extremely close to striking device 31 without the fear of unintended triggering caused by the pedal assembly overshooting the neutral position.

FIGS. 7 and 8 illustrate a modification to allow drummers to use a conventional drum shell in conjunction with the present invention. Many drummers will want the look of a conventional set to remain the same, and many tom-toms and other accessories are mounted on bass drum shells. FIGS. 7 and 7*a* are identical except for the attachment points of the pad arms.

After the rear drum head and all attachment hardware are removed as in FIGS. 7 and 7*a*, the pedal apparatus is mounted to the bottom of the shell. Pad support bracket 79 in FIG. 7 is mounted independently from the pedal apparatus. Each pad or tube or other triggering device can be mounted almost anywhere around the shell of the drum, and can be attached independently from each other as in 79*a* and 79*b* in FIG. 7*a*. The angle of pad arms 80, 81 can be varied using adjustment devices 82, 83.

Illustrated is the use of triggering devices (pads) 32, 33, each with embedded multiple electronic sensors (piezo transducers or other; 84, 85 in pad 32, 86 and 87 in pad 33). Two per pad is shown, but any number could be added. The configuration illustrated would allow a drummer to trigger blended sounds such as a bass drum and a cow bell on the downstroke, along with a conga and a gong on the upstroke (as just one example). There are literally hundreds of sound choices available in modem drum modules (sound generating computers), and my pedal takes advantage of the technology available.

FIG. 8 further illustrates the flexibility of my invention, and adds detail to one possible pedal configuration as used in FIGS. 7 and 7*a*. With the rear drum head and all hardware removed, base 36 is attached to the bass drum shell 88 using clip or bracket 89. Right support arm 26R remains the same, but left arm 92 has been lengthened to accept the hardware requirements of a vertically mounted return spring mechanism. One end of spring 27 is attached to a tab (or arm or other) 90 that is attached to the main pedal assembly. The other end of spring 27 is attached to adjustment screw 28 that goes through bracket 91 which is attached to left arm 92. Adjustment nut 30 is used to vary return spring tension. Either arm could be modified in this fashion; it doesn't necessarily have to be the left arm.

Also note in FIG. 8 that the striking device (tube, stick or other) 31 does not have to be attached vertically with respect to the main pedal assembly. Any angle will work, as long as striking device 31 returns to a neutral (at-rest) position between the triggering devices 32,33 and foot movement is not impeded. Striking device 31 can vary in length, weight or composition depending upon drummer preference.

There are two common methods used for playing drum pedals. In the first method, the ball of the foot is pressed down as the entire leg moves up and down. This is commonly referred to as the "heel-up" method. A second technique entails leaving the heel of the foot down, and pivoting at the ankle alone for pedal actuation. This method is referred to as the "heel-down" method. The drum pedal assemblies described above are well suited for drummers using the heel-up technique, but may not be as desirable for drummers accustomed to the heel-down method. Therefore, two additional embodiments are provided that are well suited for heel-down drummers.

A drum pedal D2 assembly according to another embodiment is shown in FIG. 10. Drum pedal D2 includes some of the same features of the drum pedal assemblies described above, and are identified with like reference numerals. Support stands, return and drag devices are not shown for purposes of explanation. However, it should be understood that drum pedal D2 may include any or all such features described above. While the upper tab 22 has been retained, note that the lower tab has been replaced by a pedal 118 connected to the hub body 23*a* using a linkage 117. A heel plate 120 with a hinge pin 118*b* is used to anchor the back of the pedal 118 to the base 36. The linkage 117 has several holes that can be used to attach the hinge pin at the front of the pedal 118*a* in order to adjust the spacing between the pedal 118 and the upper tab 22. The upper linkage hinge piece 116 or arm may be an integral part of the core block 23*a*, or it may be an added, adjustable piece. The leverage and stroke length of the pedal 118 are varied depending on the positioning of the upper linkage hinge piece 116 relative to hub body 23*a*.

As the pedal 118 is pressed down, the hub body 23*a* rotates about the axle 25, and the striking device 31 impacts the downstroke triggering device 32. As the upper tab 22 is lifted up with the top of the foot, the core block 23*a* rotates around the axle 25 and the upstroke triggering device 33 is impacted, as described above.

Some drummers who use the heel-down technique will not be able to reach the upstroke tab as presented in FIG. 10. This may be caused by the drummer having a short foot (kids for instance) or a technique that leaves the foot too far back in the pedal to reach the tab. As best shown in FIGS. 11 and 12, a drum pedal assembly D3 according to another embodiment may be better suited for such drummers. As with drum pedal D2, pedal 118 and linkage 117 are provided for pressing down, but upper tab 22 has been omitted.

Instead, drum pedal D3 includes a foot retaining device 121. This device could take one of many forms; a cup, a shoe wedge, a toe clip etc., as long as it can be used to receive a user's foot and be used to raise the pedal 118 when the foot is lifted. As shown in FIGS. 11 and 12, a padded strap 121 with an adjustable fastener 122, such as Velcro™, is provided. Retaining device 121 can be moved forward or back on the pedal 118 at the discretion of the drummer by using retaining screws 123 in any of the adjustment holes 124. The actual size of the device and resultant snugness around the foot can therefore be adjusted using the Velcro™ or other adjustment fastener 122.

Linkage 117 is preferably a rigid strip of material, and the optional adjustment feature of the upper linkage hinge piece 116 is shown in FIG. 12, using set screws 125 that go into adjustment holes 126. In this way, the distal end of linkage hinge piece 116 may be moved further away from or closer to hub body 23*a*. As the pedal 118 is pressed down, the hub body 23*a* rotates about the axle 25, and the striking device 31 impacts the downstroke triggering device 32. As the pedal is lifted upwards with the aid of the foot retaining device, hub body 23*a* rotates around the axle 25 and the upstroke triggering device 33 is impacted.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims. In addition, features of one embodiment may be incorporated into another embodiment.

I claim:

1. An apparatus for triggering electronic drums, comprising:

a base;

a hub body pivotally connected to said base and axially rotatable in first and second opposite directions;

a pedal coupled to said hub body via a linkage, said linkage having a first portion pivotally connected to said hub body and a second portion pivotally connected to said pedal, thereby pivotally connecting said pedal to said hub body;

a foot retaining device configured for securing a user's foot to said pedal;

a first impact sensitive electronic triggering device;

a second impact sensitive electronic triggering device;

an elongate striking device having a first end connected to said hub body and a distal second end extending outwardly from said hub body and disposed between said first and second triggering devices, said distal second end contacting said first triggering device when said pedal is depressed thereby rotating said hub body in said first direction, and said distal second end contacting said second triggering device when said pedal is raised via an upward motion of the user's foot against said foot retaining device thereby rotating said hub body in said second direction; and a return device configured for tensioning said striking device toward a neutral position between and spaced from said first and second triggering devices after rotation of said hub body in one of said first and second directions.

2. The apparatus of claim 1, further comprising an axle assembly connecting said hub body to said base, said axle assembly having an axle disposed between and supported by first and second axle arms, said hub body connected to said axle.

3. The apparatus of claim 2, further comprising a return spring having a first end connected to one of said hub body and said axle, and said return spring having a second end opposite said first end connected to said base, said return spring tensioning said striking device toward a neutral position intermediate said first and second triggering devices after rotation of said hub body in one of said first and second directions.

4. The apparatus of claim 3, wherein said second end of said return spring is connected to an adjustment bracket on said base.

5. The apparatus of claim 4, further comprising an adjustment assembly operably associated with said return spring for varying the tension thereof, said adjustment assembly having an adjustment screw and adjustment nut intermediate and connecting said second end of said return spring and said adjustment bracket.

6. The apparatus of claim 3, further comprising a dampening device having a strap having a first portion wrapped around said axle and a second portion connected to said base, said dampening device tensioned against said axle and thereby minimizing rotation of said axle beyond said neutral position after rotation of said hub body in one of said first and second directions.

7. The apparatus of claim 6, wherein said dampening device includes a dampening bracket secured to said base, and a dampening spring disposed between and connecting said second portion of said strap and said dampening bracket.

8. The apparatus of claim 7, wherein said dampening device further comprises a set screw operably associated with said dampening spring for adjusting the tension thereof.

9. The apparatus of claim 2, further comprising first and second bearing assemblies mounted on said first and second axle arms, respectively, each of said bearing assemblies having a plurality of bearings suspending a corresponding end of said axle.

10. The apparatus of claim 1, further comprising at least one triggering device bracket having a first portion connected to said base and a second portion connected to and supporting said first and second triggering devices.

11. The apparatus of claim 10, wherein said triggering device bracket includes first and second posts for receiving and supporting said first and second triggering devices, said first and second triggering devices movably disposed on said first and second posts, respectively, so that said first and second triggering devices are adjustably spaced.

12. The apparatus of claim 1, wherein said apparatus includes first and second triggering device brackets for supporting said first and second triggering devices, respectively.

13. The apparatus of claim 12, wherein said first and second triggering device brackets are moveably connected to said base so that said first and second triggering devices are adjustably spaced.

14. The apparatus of claim 1, wherein said base includes an underside having a non-skid surface.

15. The apparatus of claim 1, further comprising a rope having a first portion secured to said base and a second portion securable to one of a stool and a floor thereby restraining said base from sliding.

16. The apparatus of claim 1, wherein at least one of said first and second triggering devices includes at least two electronic sensors, each of said electronic sensors activating a desired sound when said corresponding triggering device is triggered.

17. The apparatus of claim 1, wherein said striking device includes a weight securable to said striking device and moveable along the length thereof so that said striking device has an adjustable momentum depending on a position of said weight.

18. The apparatus of claim 1, wherein said second portion of said linkage includes a plurality of openings operably associated with a pin securable to said pedal, said pedal pivotally connected to a selected one of said openings of said linkage via said pin.

19. The apparatus of claim 1, wherein said pedal includes a first end pivotally connected to said linkage, and a second end pivotally connected to said base.

20. The apparatus of claim 1, wherein said hub body includes an arm having a distal end extending outwardly therefrom, said first portion of said linkage pivotally connected to said distal end of said arm.

21. The apparatus of claim 1, wherein said first portion of said linkage is adjustably secured to said hub body so that said first portion is moveable toward and away from said hub body.

22. The apparatus of claim 1, further comprising an upper tab extending outwardly from said hub body, said pedal spaced from said upper tab to form a space therebetween for receiving a user's toes.

23. The apparatus of claim 1, wherein said foot retaining device is selected from the group consisting of a toe clip, a strap, a shoe wedge, and a toe cup.

24. The apparatus of claim 23, wherein said foot retaining device is a padded strap having first and second releasably securable portions, said padded strap adjustable for accommodating the user's foot.

* * * * *